US007387984B2

(12) United States Patent
Yoneshige et al.

(10) Patent No.: US 7,387,984 B2
(45) Date of Patent: Jun. 17, 2008

(54) THERMALLY SENSITIVE RECORDING MEDIUM

(75) Inventors: Seiki Yoneshige, Tokyo (JP); Akihito Ogino, Tokyo (JP); Mizuho Shimoyama, Tokyo (JP); Kenji Hirai, Tokyo (JP); Junpei Natsui, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 0 days.

(21) Appl. No.: 11/663,230

(22) PCT Filed: Aug. 24, 2005

(86) PCT No.: PCT/JP2005/015824

§ 371 (c)(1),
(2), (4) Date: Mar. 19, 2007

(87) PCT Pub. No.: WO2006/035567

PCT Pub. Date: Apr. 6, 2006

(65) Prior Publication Data

US 2008/0076663 A1 Mar. 27, 2008

(30) Foreign Application Priority Data

Sep. 29, 2004 (JP) ..... 2004-282904
Mar. 16, 2005 (JP) ..... 2005-075036

(51) Int. Cl.
*B41M 5/40* (2006.01)

(52) U.S. Cl. ..... 503/207; 503/200; 503/226

(58) Field of Classification Search ..... None
See application file for complete search history.

(56) References Cited

FOREIGN PATENT DOCUMENTS

JP 2005-254471 * 9/2005

* cited by examiner

*Primary Examiner*—Bruce H Hess
(74) *Attorney, Agent, or Firm*—Flynn, Thiel, Boutell & Tanis, P.C.

(57) ABSTRACT

A thermally sensitive recording medium whose luster of printed part is excellent can be provided by a thermally sensitive recording medium of single layer or multi layers having at least a thermally sensitive recording layer that contains a colorless or pale colored electron donating leuco dye and an electron accepting color developing agent on a substrate comprising, containing a pigment whose aspect ratio is 30 or more in at least one layer formed on a substrate.

3 Claims, 1 Drawing Sheet

THERMALLY SENSITIVE RECORDING MEDIUM

FIELD OF THE INVENTION

Figure 1:
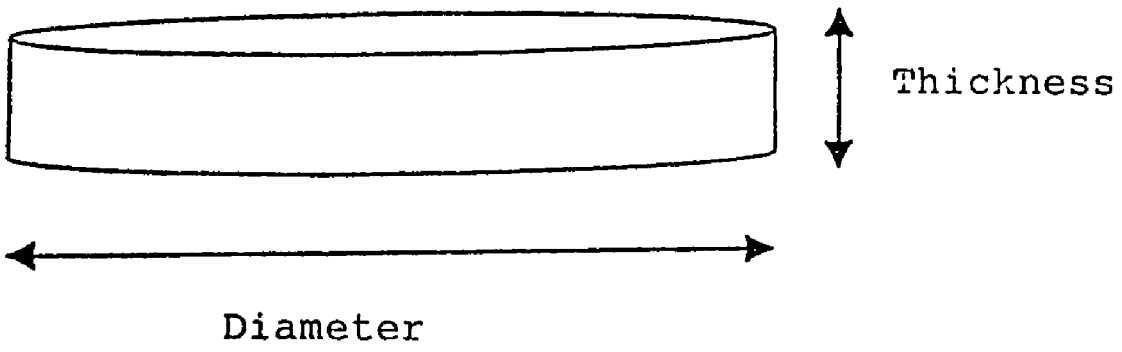

The present invention relates to a thermally sensitive recording medium which utilizes color developing reaction of a colorless or pale colored basic leuco dye with a color developing agent, in particular, relates to a thermally sensitive recording medium which is excellent in color developing sensitivity and quality of developed image.

BACKGROUND OF THE INVENTION

In general, a thermally sensitive recording medium having a thermally sensitive recording layer whose main components are colorless or pale colored electron donating leuco dye (hereinafter shortened to dye) and electron accepting color developing agent (hereinafter shortened to color developing agent) that develops color when heated with a dye is practically used widely. A thermal printer in which a thermal head is built in is used to record images on it. This thermally sensitive recording method has advantages that, noiseless at recording process, developing process and fixing process are not necessary, maintenance free, an apparatus is relatively cheap and compact and a obtained color is very clear, therefore, is widely applied in the field of a facsimile, a terminal printer of computer, an automatic ticket vendor, a recorder for measuring instrument or a handy terminal that is used in outdoor. As uses of this thermally sensitive recording medium, besides above mentioned output paper for various instruments, the thermally sensitive recording medium are becoming to be used in the field of a paper for note to which good preservability is required. Along with the diversification of uses, recording instrument itself is disversified and becoming high performance (high speed, compact), accordingly, for the thermally sensitive recoding medium, a product which has higher color developing sensitivity and can obtain high quality recorded image in all range from lower printing density to higher printing sensitivity.

In general, as the method to improve color developing sensitivity and quality of developed image, a method to improve smoothness of an under coating layer formed on the surface of a thermally sensitive recording medium or between a substrate and thermally sensitive recording layer by a super calendar is well known.

In Patent Document 1, for the purpose to provide a thermally sensitive recording material which is excellent in dot reappearance ability (quality of image), a technique to laminate first intermediate layer and second intermediate layer in order between substrate and thermally sensitive color developing layer, wherein Ohken smoothness of the first intermediate layer is 700 seconds or more and density of the second intermediate layer is 0.1 or less is disclosed. In Patent Document 2, a technique to contain scale shape silica particles in an intermediate layer formed between a substrate and a thermally sensitive recording layer is disclosed. However, in a case when the smoothness of the thermally sensitive recording medium is improved by means of super calendar, although high quality recorded image can be obtained, porosity (abiabatic ability) of the layers which construct a thermally sensitive medium is deteriorated by calendar pressure. Accordingly, thermal efficiency at the thermally sensitive layer is deteriorated and high color developing sensitivity can not be obtained. Further, recently, since the required level for quality of image is becoming higher, sufficient quality can not be obtained by only improving the smoothness of the surface of the thermally sensitive recording medium or the under coating layer.

Further, along with the diversification of uses, a thermally sensitive recording medium to which fixed informations such as logo mark or ruled lines are previously printed by a common printing method such as offset printing is becoming to be used more frequently, accordingly, a high lustrous thermally sensitive recording medium having aptitude for a common printing, especially high lustrous aptitude for a printed part is required.

In Patent Document 3, for the purpose to improve aptitude for a common printing and lustor of thermally sensitive recording medium, an art characterized to contain aluminum hydroxide in a thermally sensitive layer is disclosed and in Patent Document 4, an art to form a protecting layer for the purpose to obtain high lustrous thermally sensitive recording medium is disclosed. However, when a protection layer is formed, since heat conduction to a thermally sensitive recording layer becomes slow, not only disadvantages such as deterioration of sensitivity, deterioration of printing speed or increase of printing energy cause, but also a problem of production cost rising causes because numbers of coating layer are increased.

Further, for the purpose to obtain high color developing sensitivity, there is an art to blend a silica having high oil absorbing ability in a thermally sensitive recording medium and to fix fused dye and color developing agent, however, when silica is blended, since lustrous of a thermally sensitive recording medium is deteriorated, problem that high printing lustrous can not be obtained causes. As mentioned above, at the present time, a thermally sensitive recording medium having high color developing sensitivity and characterized that lustrous of printed part is high when printed by a common printing method such as an offset printing, is not obtained yet.

Furthermore, since basic leuco dye and color developing agent contained in a thermally sensitive recording medium can be easily dissolved in various solvent, the thermally sensitive recording medium has a problem that the developed color density is deteriorated when a developed image is contacted with chemicals such as plasticizer contained in an ink of water mark pen or oily mark pen or an adhesive. In Patent Documents 5 and 6, for the purpose to overcome said defect, an art to form a protecting layer containing a pigment and a resin as main components on a thermally sensitive recording medium is disclosed.

However, recently, uses of a thermally sensitive recording medium are extending widely, for example, for various tickets, receipt, label, for ATM use of bank, for inspection of city gas or water supply or for a note of cycle race or horse race. Therefore, severe requirement for feature of the thermally sensitive recording medium is rising, which is not required to a conventional thermally sensitive recording medium. Since these cases of use are mainly outdoor use, the function of an over coating layer, which can endure practical use in more severe environment compared with the conventional use such as rain, water, humid, sun shine or in a car of summer, becomes necessary. However, when such kind of protecting layer is formed, although stability can be improved, above mentioned disadvantage such as deterioration of sensitivity, deterioration of printing speed or increase of printing energy are caused, further, large friction is caused between pigment such as silica contained in a protecting layer with a head, a problem of abrasion of a head is caused when continuously used for long time.

(Patent Document 1) JP 2000-108528 A publication (Patent Document 2) JP 2002-137542 A publication (Patent Document 3) JP Patent No. 2786912

(Patent Document 4) JP H09-156222 A publication (Patent Document 5) JP S48-30437 A publication (Patent Document 6) JP S48-31958 A publication

DISCLOSURE OF THE INVENTION

The object of the present invention is to provide a thermally sensitive recording medium which is superior in color developing sensitivity and quality of developed image.

The inventors of the present invention continued earnest investigation, and found out that above mentioned object can be dissolved by a thermally sensitive recording medium comprising, single or multi layers, wherein, at least one layer on a substrate is a thermally sensitive recording layer that contains a colorless or pale colored electron donating leuco dye and an electron accepting color developing agent, further, at least one layer formed on the substrate contains a pigment whose aspect ratio is 30 or more. Especially, by using kaolin as a pigment whose aspect ratio is 30 or more, more excellent effect can be obtained.

Further, by containing a pigment whose aspect ratio is 30 or more in the outermost surface of the thermally sensitive recording medium, not only above mentioned object is dissolved but also displays high lustrous, aptitude for a common printing, especially high lustrous aptitude of printed part. In particular, by containing a pigment whose aspect ratio is 30 or more in a protect layer, can display excellent effect in preservative stability of the recorded image part and the white ground part and abrasion resistance of a head.

BRIEF ILLUSTRATION OF DRAWING

FIG. 1 is an illustrating drawing of aspect ratio of the present invention, and aspect ratio is indicated by numerical value calculated by dividing diameter by thickness.

DESCRIPTION OF THE PREFERRED EMBODIMENT

The thermally sensitive recording medium of the present invention is characterized by containing a pigment whose aspect ratio is 30 or more in at least one layer formed on a substrate. In the present invention, the term of "aspect ratio of a pigment" means numerical value calculated as follows. That is, powder is photographed by an electric microscope and 100 particles are picked up at random, and aspect ratio of each 100 particles are calculated and averaged, wherein, larger aspect ratio means that the pigment has larger flatness.

$$\text{Aspect ratio} = \text{diameter}/\text{thickness} \qquad \text{(formula 1)}$$

The pigment whose aspect ratio is 30 or more, which is used in the present invention is very flat compared with a pigment which is generally used as a paper manufacturing materials, and a coating layer containing the pigment has excellent covering ability, surface flatness and lustrous. The reason why can be conjectured as follows. That is, the necessary weight of the pigment having larger aspect ratio is lighter than that of the pigment having smaller aspect ratio. For example, when a pigment A whose aspect ratio is 20 and a pigment B whose aspect ratio is 40 are compared, the minimum necessary amount of the pigment B is theoretically half to the minimum necessary amount of the pigment A. Therefore, a coating layer having high covering ability can be formed by small amount of a coating. And, since the thickness of a pigment whose aspect ratio is large is thin, unevenness at the coated layer surface becomes small. Therefore, excellent surface flatness and luster can be displayed. Further a coating containing a pigment whose aspect ratio is large, has a tendency that the particles of the pigment are oriented so as the flat surface to turn upward at the coating process, and can easily display good covering ability, surface flatness and luster. In a case of the method for coating characterized that strong share is loaded, such as blade coater, this tendency becomes more remarkable. Further, when particles of pigment are oriented so as the flat surface to turn upward, since penetration into a substrate or into inner part of a coating layer is protected, coating ability, surface flatness and lustrous are improved. As mentioned above, by containing a pigment whose aspect ratio is large in a thermally sensitive recording layer, good surface flatness is performed, therefore, it is possible to control the treating pressure by a super calendar which provides aimed flatness, to the minimum level. Consequently, a thermally sensitive recording medium characterized to be porous and to be excellent in surface flatness can be obtained. Regarding a thermally sensitive recording medium containing a pigment whose aspect ratio is 30 or more of the present invention, cases that said pigment is contained in protecting layer, thermally sensitive recording layer and under coating layer will be illustrated below.

As the first, the case that a pigment whose aspect ratio is 30 or more is contained in a protecting layer will be illustrated. In the present invention, when a pigment whose aspect ratio is 30 or more is contained in a protecting layer, which is the outermost surface layer, it is possible to cover a thermally sensitive recording layer by smaller coating amount than conventional protecting layer. The construction of the thermally sensitive recording medium that contains a pigment whose aspect ratio is 30 or more in the protecting layer, which is the outermost surface layer, there are combinations of (thermally sensitive recording layer)/(protecting layer) or (undercoating layer)/(thermally sensitive recording layer)/(protecting layer), and the pigment whose aspect ratio is 30 or more can be added to the other layers too, besides the protecting layer.

By forming a protecting layer containing a pigment whose aspect ratio is 30 or more, preservative stability of the recorded image part and the white ground part are improved and deterioration of heat conduction to a thermally sensitive recording layer is protected, accordingly good color developing sensitivity and good recorded image can be obtained. Further, by containing a pigment whose aspect ratio is 30 or more, smoothness and luster of surface of a coating layer are improved. Therefore, required smoothness can be obtained by a low pressure super calendar and good color developing sensitivity and good recorded image can be obtained.

When the average diameter of the pigment whose aspect ratio is 30 or more contained in a protecting layer is larger than 4 μm, the pigment is exposed on the surface of the coating layer and causes problems such as deterioration of surface flatness, deterioration of quality of recorded image, deterioration of luster, deterioration of luster of printed part or increase of abrasion with a thermal head. Therefore, it is desirable that the particle size of the pigment whose aspect ratio is 30 or more is 4 μm or less. Further, when oil absorbing amount of a pigment whose aspect ratio is 30 or more is 30-100 ml/100 g, ink fixing ability and luster of printed part in common printing becomes good. When the oil absorbing amount of a pigment whose aspect ratio is 30 or more is 30 ml/100 g or less, problem causes in ink fixing ability, because the ink for common printing is hard to be absorbed, and when the oil absorbing amount of a pigment whose aspect ratio is 30 or more is over than 100 ml/10 g, since the ink for common printing is excessively absorbed, a thermally sensitive recording medium having high luster of printed part can not be obtained.

When the aspect ratio of a pigment contained in a protecting layer is 100 or more, problems of deterioration of ink fixing ability or ink drying feature in common printing and deterioration of color developing sensitivity are caused, because the density of the protecting layer becomes too high. Therefore, the desirable aspect ratio of the pigment contained in the thermally sensitive recording medium is 30-100, more desirably is 30-75.

As a sort of inorganic pigment used in the present invention, for example, kaolin, (calcined) kaolin, calcium carbonate, aluminum oxide, titanium oxide, magnesium carbonate, aluminum silicate, magnesium silicate, calcium silicate, aluminum hydroxide, diatomaceous earth or talk can be mentioned, however, not intending to be limited to them. Among these inorganic pigments, an inorganic pigment whose aspect ratio is 30 or more is preferably used. The inorganic pigment used in the present invention has a characteristic in its shape and ratio of thin board shape particles is larger when compared with that of ordinary used pigment. And in the present invention, a pigment that has said shape is preferably used or a pigment classified so as to meet the regulation of the present invention is used.

Further, it is desirable to use the inorganic pigment whose aspect ratio is 30 or more by alone, because it displays its effect by its specific shape, however, it can be used together with various pigments whose aspect ratio is less than 30 within the limit that the weight parts of the inorganic pigment whose aspect ratio is 30 or more is more than 50 weight parts, more desirably 80 weight parts to 100 weight parts of total blending part of pigments.

As an inorganic pigment whose aspect ratio is 30 or more, from the view point of head abrasion resistance, aluminum hydroxide, silica or kaolin is desirable. Especially, from the view point of quality of image, sensitivity, aptitude for a common printing and economy, kaolin is desirable. This kind of kaolin can be obtained by specifically grinding, delaminating and classifying kaolin.

To the protecting layer of the present invention, as a binder, for example, completely saponified polyvinyl alcohol having a degree of polymerization of 200 to 1,900, partially saponified polyvinyl alcohol, acetoacetyl polyvinyl alcohol, carboxy denatured polyvinyl alcohol, amide denatured polyvinyl alcohol, sulfonic acid denatured polyvinyl alcohol, butyral denatured polyvinyl alcohol, olefin denatured polyvinyl alcohol, nitrile denatured polyvinyl alcohol, pyrorrydone denatured polyvinyl alcohol, silicone denatured polyvinyl alcohol, other denatured polyvinyl alcohol, hydroxyethylcellulose, methylcellulose, ethylcellulose, carboxymethylcellulose, styrene-maleic anhydride copolymer, styrene-butadiene copolymer, cellulose derivative such as ethylcellulose or acetylcellulose, casein, gum arabic, starch oxide, etherificated starch, dialdehyde starch, esterficated starch, polyvinyl chloride, polyvinyl acetate, polyacrylamide, polyacrylate, polyvinyl butyral, polystyrol and a copolymer thereof, polyamide resin, silicon resin, petroleum resin, terpene resin, ketone resin and cumarone resin can be mentioned. Those high molecular weight substances can be used by dissolving in a solvent such as water, alcohol, ketones, esters, or hydrocarbon, or emulsifying or dispersing as a paste in water or another medium. Both methods can be used together in accordance with required quality.

In general, the containing amount of an inorganic pigment whose aspect ratio is 30 or more and a binder used in the present invention, solid parts of a binder is 30-300 weight parts to 100 parts of inorganic pigment.

This protecting layer can be prepared easily by applying a coating on a thermally sensitive recording layer by coating amount of approximately 1-5 g/m$^2$ using an ordinary coating machine. An intermediate layer can be formed between thermally sensitive recording layer and protecting layer and the protecting layer can be formed on the intermediate layer. As a coating method, every well-known methods such as air knife method, blade method, gravure method, roll coater method or curtain method can be used.

Secondly, a case that a pigment whose aspect ratio is 30 or more is contained in a thermally sensitive recording layer will be illustrated. In the present invention, when a pigment whose aspect ratio is 30 or more is contained in a thermally sensitive recording layer, the construction of the thermally sensitive recording medium on a substrate, there are combinations of (undercoating layer)/(thermally sensitive recording layer)/(protecting layer), (undercoating layer)/(thermally sensitive recording layer), (thermally sensitive recording layer)/(protecting layer) and (thermally sensitive recording layer) alone, and the pigment whose aspect ratio is 30 or more can be added to other layers besides the protecting layer.

In the present invention, in the case that a pigment whose aspect ratio is 30 or more is contained in a thermally sensitive recording layer, by the same reason stated previously to the case contained in the protecting layer, covering ability and smoothness are improved compared with the case which uses conventionally used pigment.

Therefore, when the construction of the thermally sensitive recording medium is (undercoating layer)/(thermally sensitive recording layer) or (thermally sensitive recording layer) alone on a substrate, that is, in the case that the pigment whose aspect ratio is 30 or more is contained in the outermost layer of the thermally sensitive recording medium, heat from a thermal head of a thermally sensitive printer is conducted equally and performs excellent color developing sensitivity, further when printed by a common printing method such as an offset printing, a thermally sensitive recording medium whose luster of the printed part is high can be obtained.

And, when the construction of the thermally sensitive recording medium is (undercoating layer)/(thermally sensitive recording layer)/(protecting layer) or (thermally sensitive recording layer)/(protecting layer) on a substrate, that is, in the case that the protecting layer is formed on the thermally sensitive recording layer in which the pigment whose aspect ratio is 30 or more is contained, since excellent smoothness of the thermally sensitive recording effects the smoothness of the protecting layer formed on it and good color developing sensitivity and good quality of the printed image can be obtained.

In the thermally sensitive recording medium of the present invention, the pigment whose aspect ratio is 30 and a pigment that can be used together with, it is desirable to use similar pigment which can be used in above mentioned protecting layer. Further, it is desirable to use the inorganic pigment whose aspect ratio is 30 or more by alone, because it displays its effect by its specific shape, however, it can be used together with various pigments whose aspect ratio is less than 30 within the limit that the weight parts of the inorganic pigment whose aspect ratio is 30 or more is more than 50 weight parts, more desirably 80 weight parts to 100 weight parts of total blending part of pigments.

In the present invention, the blending amount of the pigment whose aspect ratio is 30 or more contained in the thermally sensitive recording layer is desirably 10%-70%, more desirably 10%-50% by weight ratio to the thermally sensitive recording layer. When the blending amount is too small, smoothness and lustrous degree deteriorate. And when the blending amount is too much, since the blending ratio of dye and color developing agent becomes small, good color developing density and recorded image can not be obtained and if the thermally sensitive recording layer locates at the outermost surface, head abrasion resistance deteriorates.

As a binder to be used in a thermally sensitive recording layer of the thermally sensitive recording medium, it is desirable to select voluntarily from binders used in the protecting layer mentioned above.

Further, in the present invention, a stabilizer which displays oil resistance effect to the recorded image can be used in the range not obstructing the desired effect regarding above mentioned object of the present invention, and as the specific example of the stabilizer, 4,4'-buthylidene (6-t-butyl-3-methylphenol), 2,2'-di-t-butyl-5,5'-dimethyl-4,4'-sulphonyldiphenol, 1,1,3-tris(2-methyl-4-hydroxy-5-cyclohexylphenyl)butane or 1,1,3-tris(2-methyl-4-hydroxy-5-t-butylphenyl)butane can be added.

Furthermore, an U.V. ray absorbing agent such as benzophenons or triazols, a dispersing agent, a defoamin agent, an anti oxidant agents or a fluorescent dye can be used.

As an electron donating leuco dye used in the present invention, any kinds of dye which are public known in fields of pressure sensitive or thermally sensitive recording medium can be used and not restricted, and for example, triphenylmethane compounds, fluorane compounds, fluorene compounds or divinyl compounds are desirably used. Examples of specific colorless or pale colored dye (dye precursor) are shown as follows. These dye precursors can be used alone or together with.

Triphenyl Methane Leuco Dye 3,3'-bis(p-dimethylaminophenyl)-6-dimethylaminophthalide [another name; Crystal Violet Lacton], 3,3-bis(p-dimethylaminophenyl)phthalide [another name is Malachite Green Lactone]

Fluorane Leuco Dyes 3-diethylamino-6-methylfluorane
3-diethylamino-6-methyl-7-anilinofluorane
3-diethylamino-6-methyl-7-(o,p-dimethylanilino)fluorane
3-diethylamino-6-methyl-7-chlorofluorane
3-diethylamino-6-methyl-7-(m-trifluoromethylanilino)fluorane
3-diethylamino-6-methyl-7-(o-chloroanilino)fluorane
3-diethylamino-6-methyl-7-(p-chloroanilino)fluorane
3-diethylamino-6-methyl-7-(o-fluoroanilino)fluorane
3-diethylamino-6-methyl-7-(m-methylanilino)fluorane
3-diethylamino-6-methyl-7-n-octylanilinofluorane
3-diethylamino-6-methyl-7-n-octylaminofluorane
3-diethylamino-6-methyl-7-benzylaminofluorane
3-diethylamino-6-methyl-7-dibenzylamonofluorane
3-diethylamino-6-chloro-7-methylfluorane
3-diethylamino-6-chloro-7-anilinofluorane
3-diethylamino-6-chloro-7-p-methylanilinofluorane
3-diethylamino-6-ethoxyethyl-7-anilinofluorane
3-diethylamino-7-methylfluorane
3-diethylamino-7-chlorofluorane
3-diethylamino-7-(m-trifluoromethylanilino)fluorane
3-diethylamino-7-(o-chloroanihino)fluorane
3-diethylamino-7-(p-chloroanilino)fluorane
3-diethylamino-7-(o-fluoroanilino)fluorane
3-diethylamino-benzo[c]fluorane
3-diethylamino-benzo[c]fluorane
3-dibutylamino-6-methyl-fluorane
3-dibutylamino-6-methyl-7-anilinofluorane
3-dibutylamino-6-methyl-7-(o,p-dimethylanilino)fluorane
3-dibutylamino-6-methyl-7-(o-chloroanilino)fluorane
3-dibutylamino-6-methyl-7-(p-chloroanilino)fluorane
3-dibutylamino-6-methyl-7-(o-fluoroanilino)fluorane
3-dibutylamino-6-methyl-7-(m-trifluoromethylanilino)fluorane
3-dibutylamino-6-methyl-chlorofluorane
3-dibutylamino-6-ethoxyethyl-7-anilinofluorane
3-dibutylamino-6-chloro-7-anilinofluorane
3-dibutylamino-6-methyl-7-p-methylanilinofluorane
3-dibutylamino-7-(o-chloroanilino)fluorane
3-dibutylamino-7-(o-fluoroanilino)fluorane
3-di-n-pentylamino-6-methyl-7-anilinofluorane
3-di-n-pentylamino-6-methyl-7-(p-chloroanilino)fluorane
3-di-n-pentylamino-7-(m-trifluoromethylaniliono)fluorane
3-di-n-pentylamino-6-chloro-7-anilinofluorane
3-di-n-pentylamino-7-(p-chloroanilino)fluorane
3-pyrrolidino-6-methyl-7-anilinofluorane
3-piperidino-6-methyl-7-anilinofluorane
3-(N-methyl-N-propylamino)-6-methyl-7-anilinofluorane
3-(N-methyl-N-cyclohexylamino)-6-methyl-7-anilinofluorane
3-(N-ethyl-N-cyclohexylamino)-6-methyl-7-anilinofluorane
3-(N-ethyl-N-xylamino)-6-methyl-7-(p-chloroanilino)fluorane
3-(N-ethyl-p-toluidino)-6-methyl-7-anilinofluorane
3-(N-ethyl-N-isoamylamino)-6-methyl-7-anilinofluorane
3-(N-ethyl-N-isoamylamino)-6-chloro-7-anilinofluorane
3-(N-ethyl-N-tetrahydrofurfurylamino)-6-methyl-7-anilinofluorane
3-(N-ethyl-N-isobutylamino)-6-methyl-7-anilinofluorane
3-(N-ethyl-N-ethoxypropylamino)-6-methyl-7-anilinofluorane
3-cyclohexylamino-6-chlorofluorane
2-(4-oxahexyl)-3-dimethylamino-6-methyl-7-anilinofluorane
2-(4-oxahexyl)-3-diethylamino-6-methyl-7-anilinofluorane
2-(4-oxahexyl)-3-dipropylamino-6-methyl-7-anilinofluorane
2-methyl-6-p-(p-dimethylaminophenyl)aminoanilinofluorane
2-methoxy-6-p-(p-dimethylaminophenyl)aminoanilinofluorane
2-chloro-3-methyl-6-p-(p-phenylaminophenyl)aminoanilinofluorane
2-chloro-6-p-(p-dimethylaminophenyl)aminoanilinofluorane
2-nitro-6-p-(p-diethylaminophenyl)aminoanilinofluorane
2-amino-6-p-(p-diethylaminophenyl)aminoanilinofluorane
2-diethylamino-6-p-(p-diethylaminophenyl)aminoanilinofluorane
2-phenyl-6-methyl-6-p-(p-phenylaminophenyl)aminoanilinofluorane
2-benzyl-6-p-(p-phenylaminophenyl)aminoanilinofluorane
2-hydroxy-6-p-(p-phenylaminophenyl)aminoanilinofluorane
3-methyl-6-p-(p-dimethylaminophenyl)aminoanilinofluorane
3-diethylamino-6-p-(p-diethylaminophenyl)aminoanilinofluorane 3-diethylamino-6-p-(p-dibutylaminophenyl)aminoanilinofluorane 2,4-dimethyl-6-[(4-dimethylamino)anilino]-fluorane Fluorene Leuco Dyes 3,6,6'-tris(dimethylamino)spiro[fluorene-9,3'-phthalide]

3,6,6'-tris(diethylamino)spiro[fluorene-9,3'-phthalide]

Divinyl Leuco Dyes 3,3-bis-[2-(p-dimethylaminophenyl)-2-(p-methoxyphenyl) ethenyl]-4,5,6,7-tetrabromo phthalide 3,3-bis-[2-(p-dimethylaminophenyl)-2-(p-methoxyphenyl) ethenyl]-4,5,6,7-tetrachloro phthalide 3,3-bis-[1,1-bis(4-pyrrolidinophenyl)ethylene-2-yl]-4,5,6,7-tetrabromophthalide 3,3-bis-[1-(4-methoxyphenyl)-1-(4-pyrrolidinophenyl)ethylene-2-yl]-4,5,6,7-tetrachlorophthali Others 3-(4-diethylamino-2-ethoxyphenyl)-3-(1-ethyl-2-methylindol-3-yl)-4-azaphthalide 3-(4-diethylamino-2-ethoxyphenyl)-3-(1-octyl-2-methylindol-3-yl)-4-azaphthalide 3-(4-cydohexylethylamino-2-methoxyphenyl)-3-(1-ethyl-2-methylindol-3-yl)-4-azaphthalide 3,3-bis(1-ethyl-2-methylindol-3-yl)phthalide 3,6-bis(diethylamino)fluorane-γ-(3'-nitro)anilinolactam 3,6-bis(diethylamino)fluorane-γ-(4'-nitro)anilinolactam 1,1-bis-[2',2',2",2"-tetrakis-(p-dimethylaminophenyl)-ethenyl]-2,2-dinitrilethane 1,1-bis-[2',2',2",2"-tetrakis-(p-dimethylaminophenyl)-ethenyl]-2-β-naphthoyl ethane 1,1-bis-[2',2',2",2"-tetrakis-(p-dimethylaminophenyl)-ethenyl]-2,2-diacetylethane bis-[2,2,2',2'-tetrakis-(p-dimethylaminophenyl)-ethenyl]-methylmalonic acid dimethyl ester.

As an electron accepting color developing agent to be used in the present invention, any kinds of color developing agent which are public known in fields of pressure sensitive or thermally sensitive recording medium can be used and not restricted, and for example, inorganic acidic compound such as activated clay, attapulgite, colloidal silica or aluminum silicate, 4,4'-isopropyldiphenol, 1,1-bis(4-hydroxyphenyl)cyclohexane, 2,2-bis(4-hydroxyphenyl)-4-methylpentane, 4,4'-dihydroxydiphenylsulfide, hydroquinonemonobenzylether, 4-hydroxybenzylbenzoate, 4,4'-dihydroxydiphenylsulfone, 2,4'-dihydroxydiphenylsulfone, 4-hydroxy-4'-isopropoxydiphenylsulfone, 4-hydroxy-4'-n-propoxydiphenylsulfone, bis(3-allyl-4-hydroxyphenyl)sulfone, 4-hydroxy-4'-methyldiphenylsulfone, 4-hydroxyphenyl-4'-benzyloxyphenylsulfone, 3,4-dihydroxyphenyl-4'-methylphenylsulfone, aminobenzenesulfonamide derivatives disclosed in JPH8-59603A publication, bis(4-hydroxyphenylthioethoxy)methane, 1,5-di(4-hydroxyphenylthio)-3-oxapentane, bis(p-hydroxyphenyl)butylacetate, bis(p-hydroxyphenyl)methylacetate, 1,1-bis(4-hydroxyphenyl)-1-phenylethane, 1,4-bis[α-methyl-α-(4'-hydroxyphenyl)ethyl]benzene, 1,3-bis[α-methyl-α-(4'-hydroxyphenyl)ethyl]benzene, di(4-hydroxy-3-methylphenyl)sulfide, 2,2'-thiobis(3-tert-octylphenol), 2,2'-thiobis(4-tert-octylphenol), phenolic compound such as diphenylsulfone crosslinked compound disclosed in WO97/16420 International Publication, compound disclosed in WO02/081229 International Publication or JP2002-301873 A publication, thiourea compounds such as N,N'-di-m-chlorophenylthiourea, p-chlorobenzoic acid, stearyl gallate, bis[4-(n-octyloxycabonylamino)zinc salicylate]di-hydrate, aromatic carboxylic acid such as 4-[2-(p-methoxyphenoxy)ethyloxy]salicylic acid, 4-[3-(p-tolylsulfonyl) propyloxy]salicylic acid or 5-[p-(2-p-p-methoxyphenoxyethoxycumyl) salicylic acid and salt of these aromatic acids with polyvalent metal such as zinc, magnesium, aluminium, calcium, titanium, manganese, thin or nickel, antipyrine complex of zinc thiocyanate, complex zinc salt of terephthalaldehydic and other aromatic carboxylic acid can be mentioned. These color developing agents can be used alone or together with. Especially, diphenylsulfone crosslinked compound disclosed in WO97/16420 International Publication can be purchased as commodity name D-90 of Nihon Soda Co., ltd. Further, a compound disclosed in WO02/081229 International Publication can be purchased as commodity name D-100 of Nihon Soda Co., ltd. Still further, it is possible to contain metal chelete color developing component such as higher fatty acid metal complex salt disclosed in JP H10-258577 A publication or polyvalent hydroxyl aromatic compounds.

Further, in the present invention, conventional well-known sensitizer can be used. As the specific example of the sensitizer, fatty acid amide such as amide stearate or amide parmitate, ethylenebisamide, montan wax, polyethylene wax, 1,2-di(3-methylphenoxy)ethane, p-benzylbiphenyl, β-benzyloxynaphthalene, 4-biphenyl-p-tolylether, m-terphenyl, 1,2-diphenoxyethane, dibenzyloxalate, di(p-chlorobenzyl)oxalate, di(p-methylbenzyl)oxalate, dibenzylterephthalate, benzyl p-benzyloxybenzoate, di-p-tolylcarbonate, phenyl-α-naphthylcarbonate, 1,4-diethoxynaphthalene, phenyl 1-hydroxy-2-naphthoate, o-xylene-bis-(phenylether), 4-(m-methylphenoxymethyl)biphenyl, 4,4'-ethylenedioxy-bis-dibenzyl benzoate, dibenzoyloxymethane, 1,2-di(3-methylphenoxy)ethylene, bis[2-(4-methoxy-phenoxy)ethyl]ether, methyl p-nitrobenzoate, phenyl p-toluenesulfonate can be mentioned, however, not intending to be limited to these compounds. These sensitizers can be used alone or can be used together with.

The kinds and amount of electron donating leuco dye, electron accepting color developing agent and other components which are used in the thermally sensitive recording medium of the present invention, are decided according to the required properties and recording suitability and not restricted, however, in general, 0.5 to 10 parts of electron accepting color developing agent and 0.5 to 10 parts of sensitizer to 1 part of electron donating leuco dye are used.

Electron donating leuco dye, electron accepting color developing agent and other materials to be added by necessity are ground by a grinding machine such as ball mill, attriter or sand grinder, or by means of an adequate emulsifying apparatus, until they are ground under several micron size, then add a binder and various additives according to the object and prepare a coating liquid. The means for coating is not restricted and public known conventional methods can be used, for example, an off machine coater with various coater such as air knife coater, rod blade coater, vento blade coater, bevel blade coater or roll coater or an on machine coater can be voluntarily chosen and used. The coating amount for a thermally sensitive layer is not specifically restricted, and in general, is in the range from 2 to 12 g/m$^2$ by dry weight.

Finally, a case that a pigment whose aspect ratio is 30 or more is contained in an undercoating layer will be illustrated. In the present invention, when a pigment whose aspect ratio is 30 or more is contained in an undercoating layer, the construction of the thermally sensitive recording medium, there are combinations of (undercoating layer)/

(thermally sensitive recording layer)/(protecting layer) and (undercoating layer)/(thermally sensitive recording layer) on a substrate, and the pigment whose aspect ratio is 30 or more can be added to other layers besides the thermally sensitive recording layer.

In the present invention, in the case when the pigment whose aspect ratio is 30 or more is contained in an undercoating layer in the thermally sensitive recording medium, by same reason to the case contained in the protecting layer mentioned above, coating ability and smoothness are improved compared with the case using conventionally used pigment.

Therefore, in a case when the construction of a thermally sensitive recording medium is (undercoating layer)/(thermally sensitive recording layer)/(protecting layer), (undercoating layer)/(thermally sensitive recording layer) on a substrate, that is, the case when a thermally sensitive recording layer and/or a protecting layer is formed on an undercoating layer containing the pigment whose aspect ratio is 30 or more, since the undercoating layer having good surface smoothness effects to the smoothness of the thermally sensitive recording layer and/or the protecting layer, good color developing sensitivity and good quality of recorded image can be obtained.

In the thermally sensitive recording medium of the present invention, as a pigment whose aspect ratio is 30 or more and a pigment that can be used together with contained in the undercoating layer, it is desirable to use similar one which is used in above mentioned protecting layer. Further, the pigment whose aspect ratio is 30 or more is desirable to be used alone because it displays effect by its specific shape, however, it can be used together with various pigments whose aspect ratio is less than 30 within the limit that the weight parts of the inorganic pigment whose aspect ratio is 30 or more is more than 50 weight parts, more desirably 80 weight parts to 100 weight parts of total blending part of pigments.

Further, as a binder, it is desirable to voluntarily select from binders used in above mentioned protecting layer, and the desirable amount is 10-40 weight parts to 100 weight parts of pigment contained in the under coating layer.

In the present invention, to the protecting layer, the thermally sensitive recording layer and the undercoating layer, a crosslinking agent such as grioxal, methylol melamine, melamine formaldehyde resin, polyamideamine-epichlorohydrine resin, potassium peroxosulfate, ammonium peroxosulfate, sodium peroxosulfate, ferric chloride, magnesium chloride, borax, boric acid, alum or ammonium chloride, metallic salt of fatty acid such as zinc stearate or calcium stearate, slipping agent such as waxes or silicone resin, dyes, fluorescent dyes, U.V. ray absorbing agent, antioxidant, anti sticking agent or anti blocking agent can be voluntarily added.

As a substrate to be used in the thermally sensitive recording medium of the present invention, paper, recycled paper, synthetic paper, film, plastic film, plastic foam film or non-woven cloth and a composite sheet which is prepared by combining these substrates can be used.

The thermally sensitive recording medium of the present invention, for the purpose to improve color developing sensitivity, various public known techniques in the field of the thermally sensitive recording medium can be added suitably, for example, to carry out a smoothness treatment such as a super calendar treatment after coating process of each layer, further, can provide a back coating layer on the opposite side of the substrate to which the thermally sensitive recording is provided, for the purpose to correct the curling of the sheet. Furthermore, an intermediate layer can be suitably formed between thermally sensitive layer and protecting layer.

The thermally sensitive recording medium of the present invention can obtain good color developing sensitivity and recorded image by containing a pigment whose aspect ratio is 30 or more in any layers formed on a substrate, especially, better color developing sensitivity and recorded image can be obtained by containing it in the outermost layer, further, effect of lustrous feature at printing can be performed. In particular, since blending ratio of the pigment whose aspect ratio is 30 or more can increase in the protecting layer compared with the blending ratio of the thermally sensitive recording layer, the best effect can be obtained by containing it in the protecting layer.

EXAMPLE

The thermally sensitive recording medium of the present invention will be illustrated more actually according to the Examples. In Examples and Comparative Examples, to one surface of a substrate an under layer and a thermally sensitive color developing layer are formed and a protecting layer is formed if a need is arisen. To another surface of the substrate, a back layer is formed.

In illustration, "parts" and "%" indicates "weight parts" and "weight %". Coating liquids used for each coating layer of the thermally sensitive recording medium are prepared as follows.

Preparation of a Coating Liquid for an Under Layer

| Coating liquid for under layer 1 | |
|---|---|
| Calcined kaolin (product of Engelhard: Ansilex 90) | 90.0 parts |
| Styrene-butadiene copolymer latex (solid part 50%) | 10.0 parts |
| Water | 50.0 parts |

Mixture of above mentioned composition is mixed and stirred and coating liquid for under layer ① is prepared.

| Coating liquid for under layer 2 | |
|---|---|
| Kaolin of high aspect ratio (product of IMERYS, Contour 1500) | 90.0 parts |
| Styrene-butadiene copolymer latex (solid part 50%) | 10.0 parts |
| Water | 50.0 parts |

Mixture of above mentioned composition is mixed and stirred and coating liquid for under layer ② is prepared.

Preparation of the Coating Liquid for a Thermally Sensitive Color Developing Layer Dispersion of color developing agent of following blending ratio (A solution) and dispersion of basic colorless dye (B solution) are separately ground in wet condition by a sand grinder to average particle size of 1 μm.

| A solution (dispersion of color developing agent) | |
|---|---|
| 4-hydroxy-4'-isopropoxydiphenylsulfone | 6.0 parts |
| 10% aqueous solution of polyvinylalcohol | 18.8 parts |
| Water | 11.2 parts |

-continued

| B solution (dispersion of basic colorless dye) | |
|---|---|
| 3-dibutylamino-6-methyl-7-anilonofluorane (ODB-2) | 2.0 parts |
| 10% aqueous solution of polyvinylalcohol | 4.6 parts |
| Water | 2.6 parts |
| **C solution (dispersion of sensitizer)** | |
| 1,2-bisphenoxybenzene | 6.0 parts |
| 10% aqueous solution of polyvinylalcohol | 20.0 parts |
| Water | 11.0 parts |

Then above mentioned dispersions are mixed by following ratio and a coating liquid for recording layer is prepared.

| Coating liquid for recording layer 1 | |
|---|---|
| A solution (22% dispersion of color developing agent) | 25.7 parts |
| B solution (30% dispersion of basic colorless dye) | 18.8 parts |
| C solution (16% dispersion of sensitizer) | 25.7 parts |
| Engineered kaolin: product of IMERYS, CONTOUR 1500 (30% dispersion), oil absorption amount: 45 ml/100 g, average diameter 2.5 μm | 1.7 parts |
| 10% aqueous solution of polyvinylalcohol | 30.7 parts |
| **Coating liquid for recording layer 2** | |
| A solution (22% dispersion of color developing agent) | 18.9 parts |
| B solution (30% dispersion of basic colorless dye) | 13.9 parts |
| C solution (16% dispersion of sensitizer) | 18.9 parts |
| Engineered kaolin: CONTOUR 1500 (30% dispersion) | 10.0 parts |
| 10% aqueous solution of polyvinylalcohol | 22.6 parts |
| **Coating liquid for recording layer 3** | |
| A solution (22% dispersion of color developing agent) | 13.5 parts |
| B solution (30% dispersion of basic colorless dye) | 9.9 parts |
| C solution (16% dispersion of sensitizer) | 13.5 parts |
| Engineered kaolin: CONTOUR 1500 (30% dispersion) | 16.7 parts |
| 10% aqueous solution of polyvinylalcohol | 16.2 parts |
| **Coating liquid for recording layer 4** | |
| A solution (22% dispersion of color developing agent) | 26.9 parts |
| B solution (30% dispersion of basic colorless dye) | 19.7 parts |
| C solution (16% dispersion of sensitizer) | 26.9 parts |
| Engineered kaolin: CONTOUR 1500 (30% dispersion) | 0.2 parts |
| 10% aqueous solution of polyvinylalcohol | 32.2 parts |
| **Coating liquid for recording layer 5** | |
| A solution (22% dispersion of color developing agent) | 10.8 parts |
| B solution (30% dispersion of basic colorless dye) | 7.9 parts |
| C solution (16% dispersion of sensitizer) | 10.8 parts |
| Engineered kaolin: CONTOUR 1500 (30% dispersion) | 20.0 parts |
| 10% aqueous solution of polyvinylalcohol | 13.0 parts |
| **Coating liquid for recording layer 6** | |
| A solution (22% dispersion of color developing agent) | 18.9 parts |
| B solution (30% dispersion of basic colorless dye) | 13.9 parts |
| C solution (16% dispersion of sensitizer) | 18.9 parts |
| kaolin: (product of RIO CAPIM, Capim DG (30% dispersion) oil absorption amount: 45 ml/100 g | 10.0 parts |
| 10% aqueous solution of polyvinylalcohol | 22.7 parts |
| **Coating liquid for recording layer 7** | |
| A solution (22% dispersion of color developing agent) | 18.9 parts |
| B solution (30% dispersion of basic colorless dye) | 13.9 parts |
| C solution (16% dispersion of sensitizer) | 18.9 parts |
| kaolin: (product of RIO CAPIM, Capim NP (30% dispersion) on absorption amount: 45 ml/100 g | 10.0 parts |
| 10% aqueous solution of polyvinylalcohol | 22.7 parts |
| **Coating liquid for recording layer 8** | |
| A solution (22% dispersion of color developing agent) | 18.9 parts |
| B solution (30% dispersion of basic colorless dye) | 13.9 parts |
| C solution (16% dispersion of sensitizer) | 18.9 parts |
| silica: product of Nippon Silica, Nip Seal E-743 (30% dispersion) oil absorption amount: 110 ml/100 g | 10.0 parts |
| 10% aqueous solution of polyvinylalcohol | 22.7 parts |

-continued

| Coating liquid for recording layer 10 | |
|---|---|
| A solution (22% dispersion of color developing agent) | 18.9 parts |
| B solution (30% dispersion of basic colorless dye) | 13.9 parts |
| C solution (16% dispersion of sensitizer) | 18.9 parts |
| mica: product of Coap Chemical MK100 (30% dispersion) oil absorption amount: 25 ml/100 g | 10.0 parts |
| 10% aqueous solution of polyvinylalcohol | 22.7 parts |
| **Coating liquid for recording layer 11** | |
| A solution (22% dispersion of color developing agent) | 18.9 parts |
| B solution (30% dispersion of basic colorless dye) | 13.9 parts |
| C solution (16% dispersion of sensitizer) | 18.9 parts |
| kaolin: product of RIO CAPIM, Capim CC (30% dispersion) oil absorption amount: 45 ml/100 g | 10.0 parts |
| 10% aqueous solution of polyvinylalcohol | 22.7 parts |
| **Coating liquid for recording layer 12** | |
| A solution (22% dispersion of color developing agent) | 18.9 parts |
| B solution (30% dispersion of basic colorless dye) | 13.9 parts |
| C solution (16% dispersion of sensitizer) | 18.9 parts |
| kaolin: product of IMERYS, ASTLA plate (30% dispersion) oil absorption amount: 45 ml/100 g | 10.0 parts |
| 10% aqueous solution of polyvinylalcohol | 22.7 parts |
| **Coating liquid for recording layer 13** | |
| A solution (dispersion of color developing agent) | 18.9 parts |
| B solution (dispersion of leuco dye) | 13.9 parts |
| C solution (dispersion of sensitizer) | 18.9 parts |
| 10% aqueous solution of polyvinylalcohol | 32.7 parts |

Preparation of a Coating for a Protecting Layer

| Coating liquid for protecting layer 1 | |
|---|---|
| kaolin (product of IMERYS: Ultimat) oil absorption amount: 45 ml/100 g | 30 parts |
| carboxy denatured PVA (product of Kuraray: PVA-KL118) | 70 parts |
| polyamideepichrolohydrine (product of Seiko PMC: WS4020) | 5 parts |
| zinc starate (product of Chukyo Yushi: Hydrine L-536) | 5 parts |
| **Coating liquid for protecting layer 2** | |
| kaolin (product of IMERYS: Contour 1500) | 9.0 parts |
| carboxy denatured PVA (product of Kuraray: PVA-KL118) | 30 parts |
| polyamideepichrolohydrine (product of Seiko PMC: WS4020) | 2.0 parts |
| zinc starate (product of Chukyo Yushi: Hydrine L-536) | 2.0 parts |
| **Coating liquid for protecting layer 3** | |
| kaolin (product of DBK: DB-PLATE) oil absorption amount: 45 ml/100 g | 30 parts |
| carboxy denatured PVA (product of Kuraray: PVA-KL118) | 70 parts |
| polyamideepichrolohydrine (WS4020) | 5 parts |
| zinc starate (product of Chukyo Yushi: Hydrine L-536) | 5 parts |
| **Coating liquid for protecting layer 4** | |
| kaolin (product of IMERYS: Contour 1500) | 25 parts |
| kaolin (product of DBK: DB-PLATE) | 5 parts |
| carboxy denatured PVA (product of Kuraray: PVA-KL118) | 70 parts |
| polyamideepichrolohydrine (WS4020) | 5 parts |
| zinc starate (product of Chukyo Yushi: Hydrine L-536) | 5 parts |
| **<Preparation of a coating for a back layer>** | |
| aluminum hydroxide | 50 parts |
| 10% aqueous solution of polyvinylalcohol (Kuraray: PVA117) | 500 parts |
| Water | 70 parts |

Preparation of a Coating for a Back Layer aluminum hydroxide 50 parts

10% aqueous solution of polyvinylalcohol (Kuraray: PVA117) 500 parts

Water 70 parts

No Protecting Layer, High Aspect Ratio Pigment is Blended in Thermally Sensitive Layer (Blending Ratio is Changeable)

Example 1

Coating liquid for under layer 1 is coated on wood free paper (grammage: 47 g/m$^2$) by a Maier bar and dried by a draft dryer (120° C., 1 minute). On the under layer, the coating liquid for recording layer 1 is coated by a Maier bar and dried by a draft dryer (60° C., 2 minutes). Further, the coating liquid for back layer is coated on the reverse surface by a Maier bar and dried by a draft dryer (60° C., 2 minutes), then treated by a super calendar so as the smoothness to be 500-700 seconds and a thermally sensitive recording medium is prepared. Wherein, the coating amount calculated by weight difference of the coating for under coating layer, the coating for recording layer and the coating for back layer are 8 g/m$^2$, 5.1 g/m$^2$ and 0.3 g/m$^2$.

Example 2

By same method to Example 1 except using a coating liquid for recording layer 2, a thermally sensitive recording medium is prepared.

Example 3

By same method to Example 1 except using a coating liquid for recording layer 3, a thermally sensitive recording medium is prepared.

Example 4

By same method to Example 1 except using a coating liquid for recording layer 4, a thermally sensitive recording medium is prepared.

Example 5

By same method to Example 1 except using a coating liquid for recording layer 5, a thermally sensitive recording medium is prepared.

Example 6

By same method to Example 1 except using a coating liquid for recording layer 10, a thermally sensitive recording medium is prepared.

Pigment in Thermally Sensitive Recording is Changed

Example 7

By same method to Example 1 except using a coating liquid for recording layer 11, a thermally sensitive recording medium is prepared.

Example 8

By same method to Example 1 except using a coating liquid for recording layer 12, a thermally sensitive recording medium is prepared.

No Protecting Layer, Ordinary Pigment is Blended in a Thermally Sensitive Layer

Comparative Example 1

By same method to Example 1 except using a coating liquid for recording layer 6, a thermally sensitive recording medium is prepared.

Comparative Example 2

By same method to Example 1 except using a coating liquid for recording layer 7, a thermally sensitive recording medium is prepared.

Comparative Example 3

By same method to Example 1 except using a coating liquid for recording layer 8, a thermally sensitive recording medium is prepared.

With Protecting Layer, High Aspect Ratio Pigment is Blended in Under Layer and Protecting Layer Example 9

By same method to Example 1 except using a coating for recording layer 13, a thermally sensitive recording layer is formed, then a coating liquid for protecting layer 2 is coated on it by a Maier bar and dried by a draft dryer (60° C., 2 minutes). Further, a coating liquid for back layer is coated by a Maier bar and dried by a draft dryer (60° C., 2 minutes) same as to Example 1 and treated by a super calendar so as the smoothness to be 1500-2000 seconds and a thermally sensitive recording medium is obtained. Wherein, coating amount of the protecting layer calculated from weight difference is 2.6 g/m$^2$.

Example 10

By same method to Example 9 except using a coating liquid for protecting layer 1, a thermally sensitive recording medium is prepared.

No Protecting Layer, Pigment of High Aspect Ratio is Blended in an Under Layer and a Thermally Sensitive Layer Example 11

By same method to Example 2 except using a coating liquid for under layer 2, a thermally sensitive recording medium is prepared.

Example 12

A coating liquid for protecting layer 2 is coated on the thermally sensitive recording medium prepared in Example 11 by the same method to Example 9 and a thermally sensitive recording medium is prepared.

With Protecting Layer, High Aspect Ratio Pigment is Blended in Under Layer, Thermally Sensitive Layer and Protecting Layer Example 13

A coating liquid for protecting layer 2 is coated on the thermally sensitive recording medium prepared in Example 2 by the same method to Example 9 and a thermally sensitive recording medium is prepared.

With Protecting Layer, High Aspect Ratio Pigment is Blended in Under Layer and Protecting Layer Example 14

By same method to Example 9, except using a coating liquid for under layer 2, a thermally sensitive recording medium is prepared.

With Protecting Layer

Comparative Example 4

By same method to Example 9, except using a coating liquid for protecting layer 3, a thermally sensitive recording medium is prepared.

With Protecting Layer, High Aspect Ratio Pigment is Blended in Thermally Sensitive Layer Example 15

By same method to Example 13, except using a coating liquid for protecting layer 3, a thermally sensitive recording medium is prepared.

With Protecting Layer, High Aspect Ratio Pigment is Blended in Under Layer and Thermally Sensitive Layer Example 16

By same method to Example 12, except using a coating liquid for protecting layer 3, a thermally sensitive recording medium is prepared.

With Protecting Layer, No Under Layer, High Aspect Ratio Pigment is Blended in Protecting Layer Example 17

Coating liquid for thermally sensitive layer 13 is coated on wood free paper (grammage: 47 g/m$^2$) by a Maier bar and dried by a draft dryer (60° C., 2 minute). On the paper, the coating liquid for protecting layer 2 is coated by a Maier bar and dried by a draft dryer (60° C., 2 minutes). Further, the coating liquid for back layer is coated on the reverse surface by a Maier bar and dried by a draft dryer (60° C., 2 minutes), then treated by a super calendar so as the smoothness to be 500-700 seconds and a thermally sensitive recording medium is prepared. Wherein, the coating amount calculated by weight difference of the coating for under coating layer, the coating for recording layer and the coating for back layer are 5.1 g/m$^2$, 2.5 g/m$^2$ and 0.3 g/m$^2$.

With Protecting Layer, No Under Layer

Comparative Example 5

By same method to Example 17, except using a coating liquid for protecting layer 3, a thermally sensitive recording medium is prepared.

With Protecting Layer, No Under Layer, High Aspect Ratio Pigment is Blended in Thermally Sensitive Layer Example 18

By same method to Example 17, except using a coating liquid for recording layer 2 and a coating liquid for protecting layer 3, a thermally sensitive recording medium is prepared.

No Protecting Layer, No Under Layer, High Aspect Ratio Pigment is Blended in Thermally Sensitive Layer Example 19

Coating liquid for recording layer 2 is coated on wood free paper (grammage: 47 g/m$^2$) by a Maier bar and dried by a draft dryer (60° C., 2 minute). Further, the coating liquid for back layer is coated on the reverse surface by a Maier bar and dried by a draft dryer (60° C., 2 minutes), then treated by a super calendar so as the smoothness to be 500-700 seconds and a thermally sensitive recording medium is prepared. Wherein, the coating amount calculated by weight difference of the coating for recording layer, the coating for protecting layer and the coating for back layer are 5.1 g/m$^2$ and 0.3 g/m$^2$.

With Protecting Layer, No Under Layer, High Aspect Ratio Pigment is Blended in Thermally Sensitive Layer and Protecting Layer Example 20

By same method to Example 17, except using a coating liquid for recording layer 2, a thermally sensitive recording medium is prepared No Protecting Layer, No Under Layer Comparative Example 6

By same method to Example 19, except using a coating liquid for recording layer 13, a thermally sensitive recording medium is prepared.

With Protecting Layer, High Aspect Ratio Pigment is Blended in Under Layer

Example 21

By same method to Comparative Example 4, except using a coating liquid for under layer 2, a thermally sensitive recording medium is prepared.

No Protecting Layer, High Aspect Ratio Pigment is Blended in Under Layer

Example 22

By same method to Comparative Example 2, except using a coating liquid for under layer 2, a thermally sensitive recording medium is prepared.

With Protecting Layer, Pigments for Over Layer is Used Together

Example 23

By same method to Example 15, except using a coating liquid for protecting layer 4, a thermally sensitive recording medium is prepared.

Aspect ratio of used pigment and oil absorbing amount of the used pigment are summarized in Table 1, and functions of Examples and Comparative Examples are summarized in Table 1. And the specific method for measuring and evaluation of the characteristics of pigments and thermally sensitive recording medium are illustrated below.

Average Diameter

Pigment is photographed by an electric microscope and 100 particles are picked up at random, and length of X axis direction, Y axis direction and Z axis direction of the particles are measured, and calculate the diameter of each particle by averaging the longest axis and second longest axis, and the average value is obtained.

Aspect Ratio 100 particles are picked up at random, and ratio of diameter and length (thickness) of shortest axis is calculated (formula mentioned below) and an average value is obtained.

Aspect ratio=diameter/thickness

Oil Absorption Amount

Measured by the method prescribed in JIS-K-5101

Recording Density

Printed by a thermal printer TH-PMD (No. 8), which is a product of Ohkura, and #14 part is measured by a Macbeth Densitometer.

Lustrous Degree of Printed Part

60° lustrous degree of each specimen is measured by a luster meter, which is a product of Murakami Color technique Laboratory, in accordance with JISZ-8741.

⊙: lustrous degree is 80% or more
○: more than 50%, less than 80%
Δ: more than 30%, less than 50%
X: less than 30%

Quality of Recorded Image

Full Printed Part is Evaluated by Inspector's Eye

⊙: removal of a recorded surface is not observed at all
○: removal in a recorded surface is not observed
Δ: removal of recorded surface is observed only a little
X: many removals are observed Abrasion of Head Abrasion of a head by prepared thermally sensitive recording media is measured by a thermal printer DPU-411, which is a product of Seiko Electric Industries, after 1,000,000 lines are printed using the pattern for evaluation of head abrasion.

⊙: head abrasion is not observed
○: head abrasion is observed only a little
Δ: hard head abrasion is observed
X: head is crushed before 1,000,000 lines printing

TABLE 1

| | aspect ratio | average diameter μm | oil absorption amount ml/100 g |
|---|---|---|---|
| Ansilex 90 | 1.1 | 1.6 | 65 |
| CONTOUR 1500 | 60 | 2.5 | 45 |
| Capim DG | 11 | 1.2 | 45 |
| Capim NP | 20 | 2.2 | 45 |
| Nip seal E-743 | 1.1 | 3.5 | 110 |
| Capim CC | 35 | 4.8 | 45 |
| ASTLA plate | 34 | 2.0 | 45 |
| DB-plate | 10 | 2.8 | 45 |
| Ultimat | 5.8 | 5.3 | 45 |

TABLE 2

| | recording density | quality of image | head abrasion | printing luster | plasticizer resistance | water resistance |
|---|---|---|---|---|---|---|
| Example 1 | 1.41 | ○ | ○ | Δ | Δ | Δ |
| Example 2 | 1.5 | ⊙ | ○ | ○ | Δ | Δ |
| Example 3 | 1.33 | ⊙ | ○ | ○ | Δ | Δ |
| Example 4 | 1.37 | Δ | ○ | Δ | Δ | Δ |
| Example 5 | 1.28 | ○ | Δ | ⊙ | Δ | Δ |
| Example 6 | 1.26 | ○ | Δ | Δ | Δ | Δ |
| Example 7 | 1.28 | Δ | ○ | Δ | Δ | Δ |
| Example 8 | 1.32 | ○ | ○ | ○ | Δ | Δ |
| Example 9 | 1.39 | ⊙ | ⊙ | ○ | ⊙ | ⊙ |
| Example 10 | 1.33 | ○ | ○ | ○ | ⊙ | ⊙ |
| Example 11 | 1.39 | ○ | ○ | ○ | Δ | Δ |
| Example 12 | 1.55 | ⊙ | ⊙ | ⊙ | ⊙ | ⊙ |
| Example 13 | 1.58 | ⊙ | ⊙ | ⊙ | ⊙ | ⊙ |
| Example 14 | 1.54 | ⊙ | ⊙ | ⊙ | ⊙ | ⊙ |
| Co. Exp. 1 | 1.21 | Δ | X | Δ | Δ | Δ |
| Co. Exp. 2 | 1.11 | Δ | X | X | Δ | Δ |
| Co. Exp. 3 | 1.2 | Δ | ⊙ | Δ | Δ | Δ |
| Co. Exp. 4 | 1.33 | Δ | X | Δ | ⊙ | ⊙ |
| Example 15 | 1.36 | ○ | X | Δ | ⊙ | ⊙ |
| Example 16 | 1.32 | ○ | X | Δ | ⊙ | ⊙ |
| Example 17 | 1.41 | ⊙ | ⊙ | ⊙ | ⊙ | ⊙ |
| Example 18 | 1.29 | ○ | X | Δ | ⊙ | ⊙ |
| Example 19 | 1.25 | ⊙ | ○ | ○ | Δ | Δ |
| Example 20 | 1.38 | ○ | ⊙ | ⊙ | ⊙ | ⊙ |
| Example 21 | 1.22 | ○ | X | Δ | ⊙ | ⊙ |
| Example 22 | 1.26 | ○ | Δ | Δ | Δ | Δ |
| Example 23 | 1.43 | ○ | X | Δ | ⊙ | ⊙ |
| Co. Exp. 5 | 1.18 | Δ | X | Δ | ⊙ | ⊙ |
| Co. Exp. 6 | 1.04 | X | Δ | X | Δ | Δ |

INDUSTRIAL APPLICABILITY

By the present invention, a thermally sensitive recording medium, which is excellent in color developing sensitivity and quality of developed image can be obtained. Further, by containing a pigment whose aspect ratio is 30 or more, above mentioned problems are dissolved and a thermally sensitive recording medium having aptitude for a common printing, especially luster aptitude of printed part can be obtained. In particular, by containing a pigment whose aspect ratio is 30 or more, a thermally sensitive recording medium characterized that preservative stability of recorded image part and white part are improved and less head abrasion can be obtained.

The invention claimed is:

1. A thermally sensitive recording medium comprising, single or multi layers, wherein, at least one layer on a substrate is a thermally sensitive recording layer that contains a colorless or pale colored electron donating leuco dye and an electron accepting color developing agent, further, at least one layer formed on the substrate contains a pigment whose aspect ratio is 30 or more.

2. The thermally sensitive recording medium of claim 1, wherein the pigment whose aspect ratio is 30 or more is kaolin.

3. The thermally sensitive recording medium of claim 1, wherein the pigment whose aspect ratio is 30 or more is contained in the outermost layer of the thermally sensitive recording medium.

* * * * *